US009169701B2

(12) United States Patent
Andresen et al.

(10) Patent No.: US 9,169,701 B2
(45) Date of Patent: Oct. 27, 2015

(54) RESTRAINING DEVICE FOR A TENSIONER ASSEMBLY

(75) Inventors: Kurt Andresen, Kristiansand (NO); Knut Halvorsen, Lillesand (NO); Anders Chr. Hannevig, Skoppum (NO)

(73) Assignee: Aker MH AS, Kristiansand (NO)

( * ) Notice: Subject to any disclaimer, the term of this patent is extended or adjusted under 35 U.S.C. 154(b) by 0 days.

(21) Appl. No.: 14/117,335

(22) PCT Filed: May 11, 2012

(86) PCT No.: PCT/EP2012/058753

§ 371 (c)(1), (2), (4) Date: Dec. 4, 2013

(87) PCT Pub. No.: WO2012/156303

PCT Pub. Date: Nov. 22, 2012

(65) Prior Publication Data

US 2014/0186125 A1 Jul. 3, 2014

(30) Foreign Application Priority Data

May 13, 2011 (NO) ..... 20110719

(51) Int. Cl.
*E21B 19/00* (2006.01)
*E02B 17/02* (2006.01)

(52) U.S. Cl.
CPC ..... *E21B 19/006* (2013.01); *E02B 17/021* (2013.01); *E21B 19/00* (2013.01); *E21B 19/004* (2013.01)

(58) Field of Classification Search
CPC ..... E02B 17/021; E21B 19/00; E21B 19/004; E21B 19/006; E21B 19/09
USPC ..... 405/195.1, 196, 201, 202, 211, 224, 405/224.1, 22.2, 224.4
See application file for complete search history.

(56) References Cited

U.S. PATENT DOCUMENTS

| | | | | |
|---|---|---|---|---|
| 3,139,852 | A * | 7/1964 | Morris | 114/230.18 |
| 3,955,522 | A * | 5/1976 | Gaudiano et al. | 114/259 |
| 4,727,693 | A * | 3/1988 | Rockenfeller et al. | 52/163 |
| 6,017,168 | A | 1/2000 | Fraser, Jr. et al. | |
| 2004/0134661 | A1 | 7/2004 | von der Ohe | |
| 2006/0102356 | A1 * | 5/2006 | Torgersen | 166/355 |
| 2010/0047024 | A1 | 2/2010 | Curtiss, III | |

* cited by examiner

*Primary Examiner* — John Kreck
*Assistant Examiner* — Carib Oquendo
(74) *Attorney, Agent, or Firm* — Birch, Stewart, Kolasch & Birch, LLP

(57) ABSTRACT

An apparatus for restraining an assembly suspended by a structure on an offshore platform or vessel, includes a movable carrier configured for controllable movement on a structure of the platform or vessel. A restraining member is movably connected to the carrier via a joint and the restraining member includes an abutment region for abutment with at least one element of the assembly. An assembly-locking device is provided for selectively and releasably locking at least one element of the assembly to the restraining member. A restraining device for a tensioner assembly which is suspended by a structure on an offshore platform or vessel and extending into a moonpool, includes a pair of restraining apparatuses, arranged on opposite sides of the moonpool and individually movable on respective rails by a traction device in interaction with respective racks.

19 Claims, 5 Drawing Sheets

RESTRAINING DEVICE FOR A TENSIONER ASSEMBLY

FIELD OF THE INVENTION

The invention concerns devices for restraining and supporting equipment on a movable platform, such as a vessel floating in water. More specifically, the invention concerns an apparatus for restraining an assembly suspended by a structure on an offshore platform or vessel comprising a movable carrier configured for controllable movement on a structure of the platform or vessel, and a restraining device for a tensioner assembly which is suspended by a structure on an offshore platform or vessel and extending into a moonpool.

BACKGROUND OF THE INVENTION

In the offshore petroleum industry it is well known to use tensioner systems on floating drilling rigs and other vessels, in order to maintain a pre-selected vertical tension in a marine riser extending from the rig and down to a subsea wellhead. When the vessel is heaving and rolling due to waves, currents and winds, the tensioner system will try to keep constant tension in the riser.

One type of tensioner system which is known in the art, is termed a "direct acting tensioner" (DAT) system. In a typical arrangement on a drilling vessel, a DAT system basically comprises a number of hydraulic-pneumatic cylinders suspended underneath the drill floor in a circle-symmetrical configuration above the lower deck. The cylinders' free (lower) ends are connected to a so-called tensioner ring, which may be connected to a telescopic joint which in turn is connected to the marine riser.

When the DAT system is not in use and not connected to the telescopic joint, the tensioner assembly is "parked" in a location away from the well centre, on the x-mas tree side or on the BOP side, where it does not interfere with other operation taking place above or through the moonpool. However, as the drilling rig may be moving considerably in waves and swell, the cylinders (and thus the tensioner ring) of a parked DAT system is susceptible of swinging uncontrolled back and forth, with the risk of damaging adjacent equipment—as well as the cylinders themselves—and causing harm to personnel.

Methods and means of DAT system seafastening exist, commonly employing an arrangement of wires and winches. The known systems are, however, cumbersome and time consuming to connect and activate. In addition, the prior art seafastening systems induce large, undesired, forces on the cylinders and/or packing boxes.

The uncontrolled movement of the DAT system also makes connecting the tensioner ring to the telescopic joint difficult and potentially dangerous.

Another problem with DAT systems arises when the tensioner ring is connected to the telescopic joint and the DAT system is in operation: Due to the rig motions, the hydraulic and/or pneumatic hoses extending from the control systems and to each of the tensioner cylinders are swinging about in the moonpool in an uncontrolled manner, and are often damaged.

The state of the art includes US 2010/0047024 A1 (Curtiss) which describes an apparatus to restrain a riser tensioner of an offshore drilling rig and which includes a restraint cone configured to fit within hydraulic cylinders of the riser tensioner, a hoist configured to extend and retract the restraint cone, and a tension member extending from a lower end of the restraint cone, the tension member configured to engage a lower end of the riser tensioner and maintain a wedging action between the restraint cone and the hydraulic cylinders.

The present inventor has devised and embodied this invention to overcome these shortcomings and to obtain further advantages.

SUMMARY OF THE INVENTION

The invention is set forth and characterized in the independent claims, while the dependent claims describe other characteristics of the invention.

The purpose of the invention is to achieve a restraining and seafastening device for a riser tensioning system or similar equipment which is safe and reliable, easy to assemble and disassemble, and does not subject the system to unwanted loads.

Another purpose of the invention is to provide a guiding device for aiding in the connection of the tensioner ring to the telescopic joint, and contribute to closing the hinged tension ring.

It is thus provided an apparatus for restraining an assembly suspended by a structure on an offshore platform or vessel, comprising a movable carrier configured for controllable movement on a structure of the platform or vessel, characterized by a restraining member which is movably connected to the carrier via a joint and where the restraining member comprises an abutment region for abutment with at least one element of the assembly, and assembly-locking means for selectively and releasably locking at least one element of the assembly to the restraining member.

In one embodiment, the abutment region defines a first recessed portion of the retraining member between protruding ends, and the first recessed portion comprises a centrally located second recessed portion which has a shape which is complementary with at least one element of the assembly.

In one embodiment, actuator means are connected between the carrier and the restraining member and configured for controllably moving the restraining member with respect to the carrier and the assembly, between a first position where at least a portion of the abutment region is in contact with at least on element of the assembly and a second position where the abutment region is not in contact with the assembly.

In one embodiment, the joint comprises a bolt extending through the restraining member and through a elongated slot in the carrier, whereby the restraining member is rotatable about the bolt axis and movable in the slot longitudinal direction.

Preferably, the apparatus comprises member-locking means for releasably and selectively locking the restraining member to the carrier, and carrier-locking means for releasably and selectively locking the carrier to the structure.

In one embodiment, the carrier comprises traction means configured for interaction with a track on the structure and support means for interaction with the structure.

In one embodiment, the restraining member comprises a plate element slidably supported by, and movably connected to, the carrier.

It is also provided a restraining device for a tensioner assembly which is suspended by a structure on an offshore platform or vessel and extending into a moonpool, characterized by a pair of apparatuses according to the invention, arranged on opposite sides of the moonpool and being individually movable on respective rails by traction means in interaction with respective racks.

In one embodiment, the tensioner assembly is suspended by trip savers slidably attached to the structure, and the structure comprises the lower side of a drill floor.

Each apparatus preferably comprises motion control means for controlling the motion of the apparatus on the rails.

In one embodiment, the tensioner assembly comprises a plurality of tensioner cylinders and the restraining member of each apparatus is configured for restraining half of the total number of tensioner cylinders.

In one embodiment, the restraining member is a plate having a recessed abutment portion which comprises a resilient material, for abutment against the tensioner cylinders.

In one embodiment, the tensioner assembly is a Direct Acting Tensioner (DAT) assembly, and each restraining member comprises locking lugs for selective and releasable locking interaction with corresponding locks on respective collars on each respective tensioner cylinder.

With the present invention, the riser tensioner may be secured and guided in a controlled manner, even when the riser tensioner is connected to the marine riser and the riser extends up between the tensioner cylinders. The invented apparatus and device supports and stabilizes the tensioner cylinders on a semi-submersible drilling rig, also when the cylinders are not connected to a marine riser. The invention provides guidance and stabilisation to the DAT cylinder arrangement when skidding the trip saver between the parked positions and well centre, and secures the DAT cylinders in either parked position when DAT system is not in use (not connected to a riser), thus serving a function of seafastening.

BRIEF DESCRIPTION OF THE DRAWINGS

These and other characteristics of the invention will be clear from the following description of a preferential form of embodiment, given as a non-restrictive example, with reference to the attached drawings wherein.

DETAILED DESCRIPTION OF A PREFERENTIAL EMBODIMENT

Figure 1:
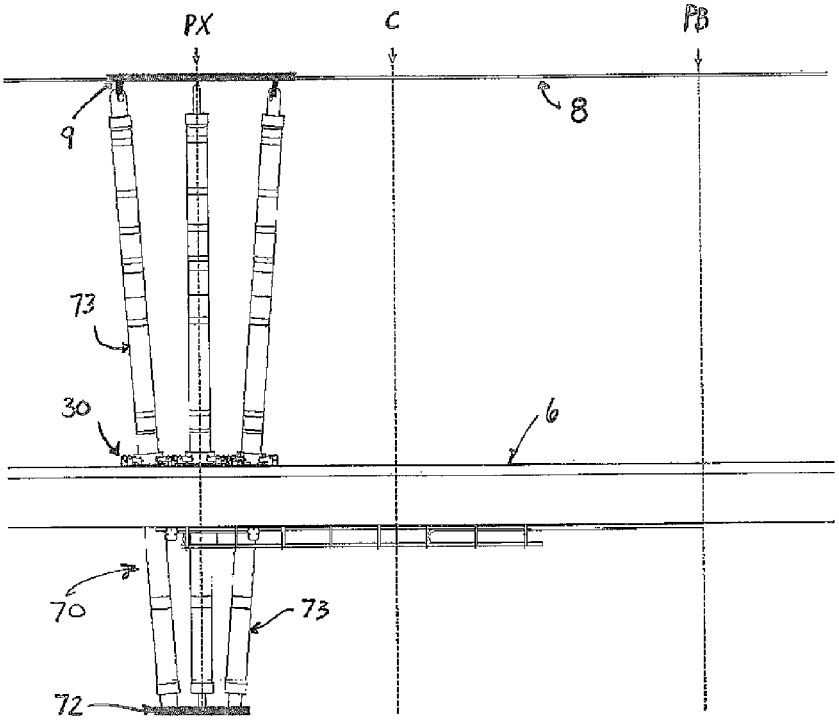
FIG. 1 is a schematic elevation view of an embodiment of the device according to the invention in use on a DAT system on a drilling rig, the DAT system being connected to a tensioner ring and suspended by a trip saver.
Figure 2:
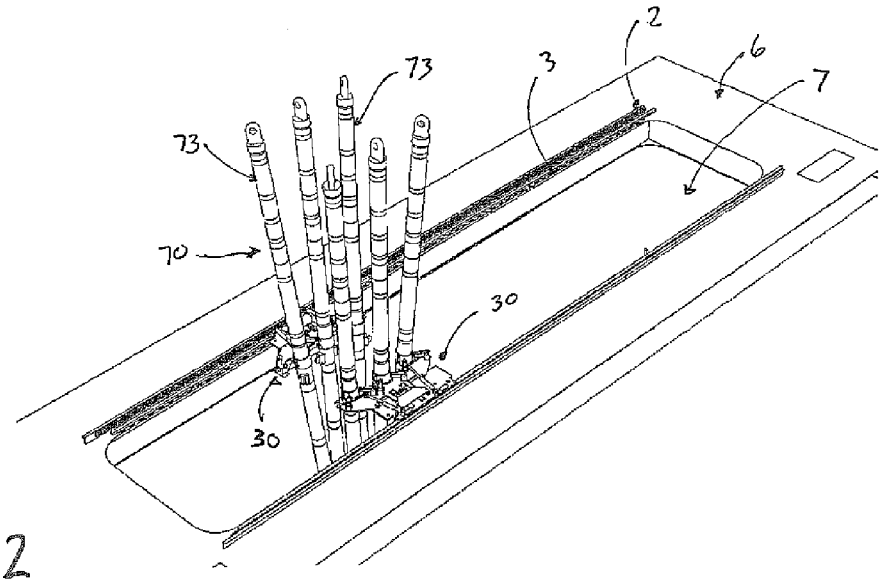
FIG. 2 is a perspective view of an embodiment of the device according to the invention connected to a DAT system in a moonpool.
Figure 3:
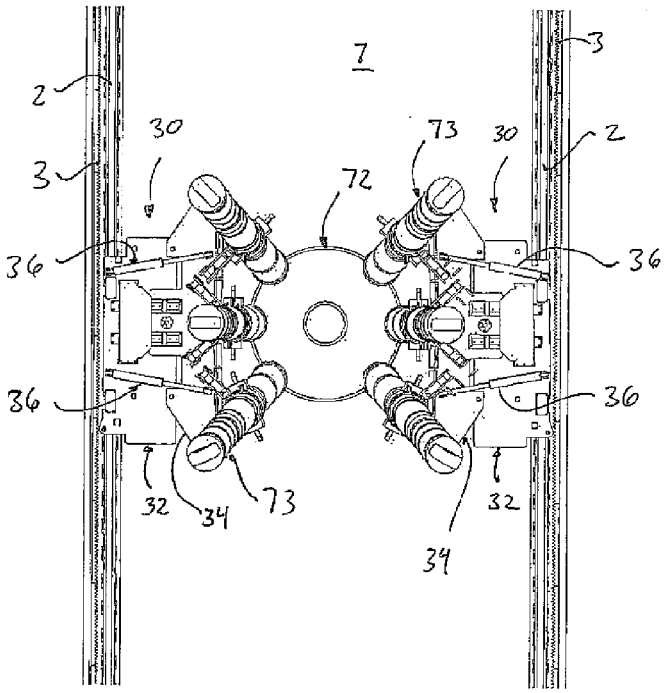
FIG. 3 illustrates the embodiment of FIG. 2, seen from above.

Referring initially to FIGS. 1 and 2, the invented device comprises two similar and independent trolleys 30, in the illustrated embodiment arranged one on each rail 2 on a deck 6 along a moonpool 7. The deck 6, which is commonly referred to as a cellar deck, is located below a drill floor, the underside of which is denoted by reference number 8.

A Direct Acting Tensioner (DAT) system 70—which is well known in the art—comprises in the illustrated embodiment six cylinders 73 which are suspended in pairs of three to respective trip saver plates (see also FIG. 9) underneath the drill floor 8. As is well known in the art, the trip saver plates are skidding plates used to skid the DAT cylinders between the various positions in the moonpool 7, such as the x-mas tree parked position PX, the well centre C, and the BOP (blow-out preventer) parked position PB. The DAT cylinders are at their lower ends connected to a tensioner ring 72, which is turn is connectable to a telescopic joint and a marine riser (not shown). Required hydraulic lines and control cables for the DAT system has been omitted from the illustrations, as the illustration of these components are not necessary for describing the invention.

Figure 5:
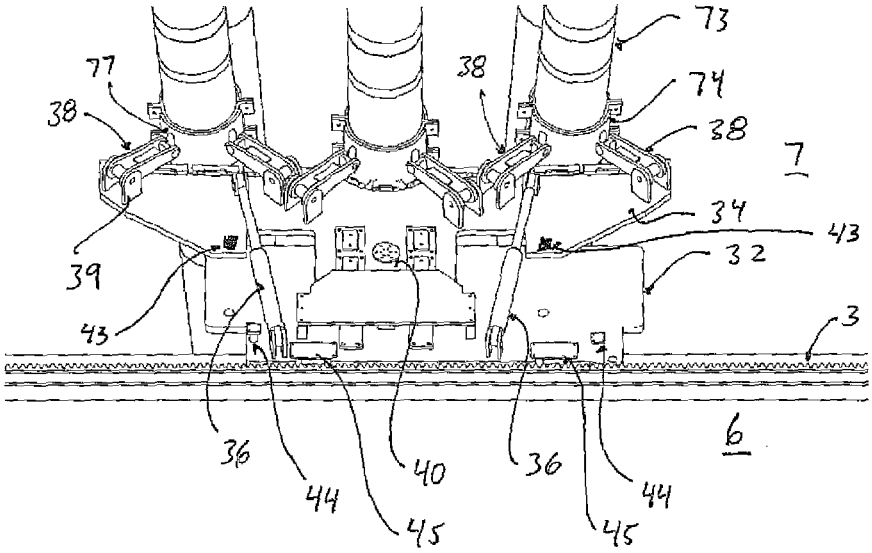
Figure 6:
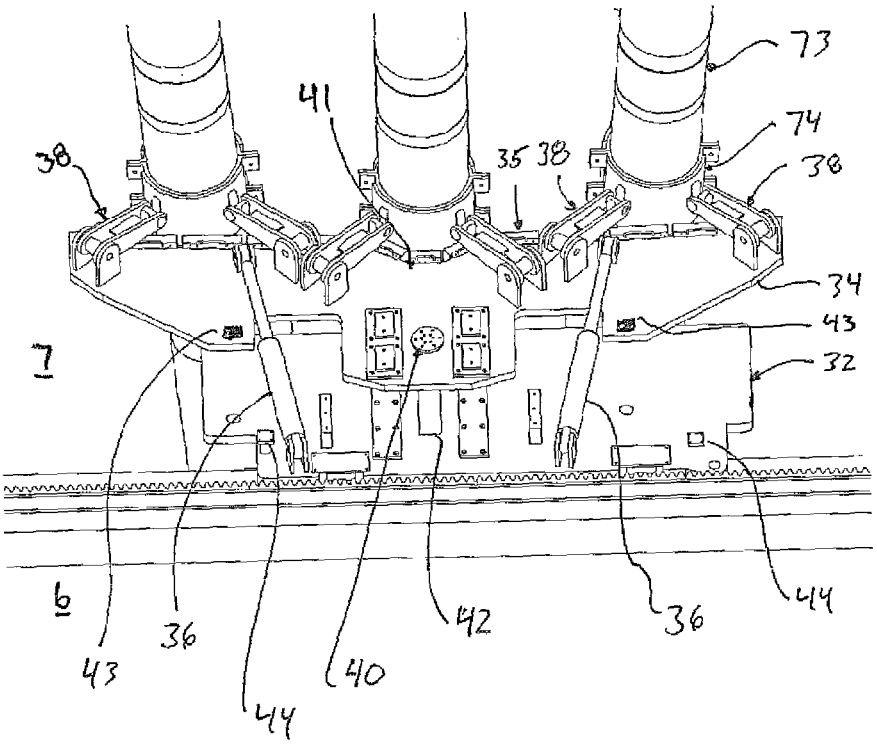

The trolley 30, hereinafter also referred to as a DAT Stabilizing Trolley, or DST, has a range of movement along the moonpool which corresponds to the skidding length for the trip saver. As will be described below, each trolley 30 is movable along the rail 2 by means of a motor and cog wheel 45 (see FIG. 5) interacting with the rack 3; i.e. a regular rack-and-pinion system.

Turning now to FIGS. 3-6, 9 and 10, the trolley 30 comprises two key elements: a carriage 32 and a restraining—or stabilizer—plate 34.

Figure 4:
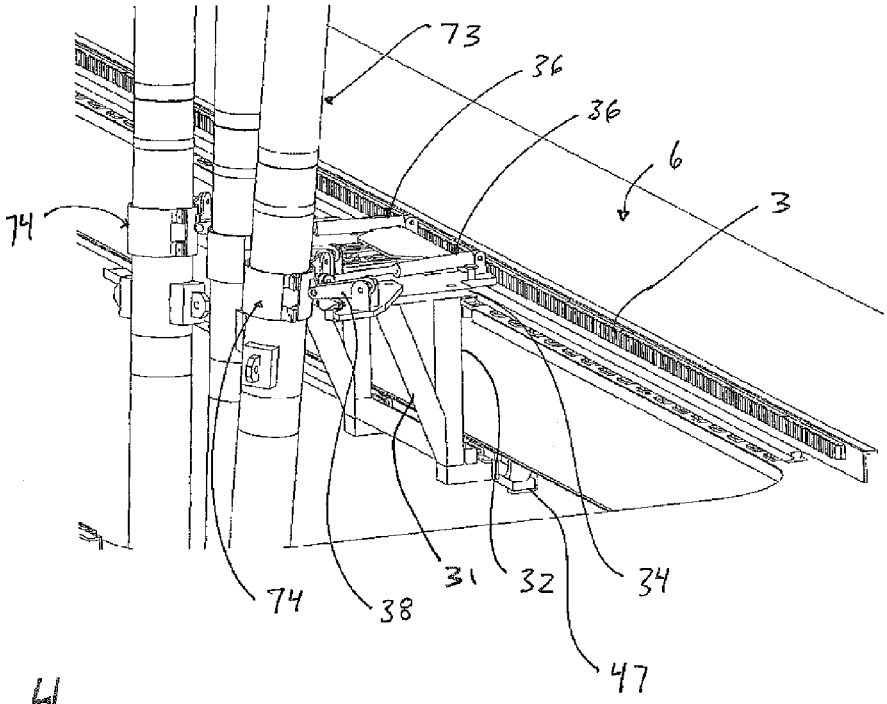
FIGS. 4-7 are perspective views of the apparatus according to the invention, and three DAT cylinders, in a moonpool (in FIGS. 6 and 7 an upper support plate has been removed to show the pivot point bolt in the plate and the corresponding guide-slot in the trolley)
Figure 9:
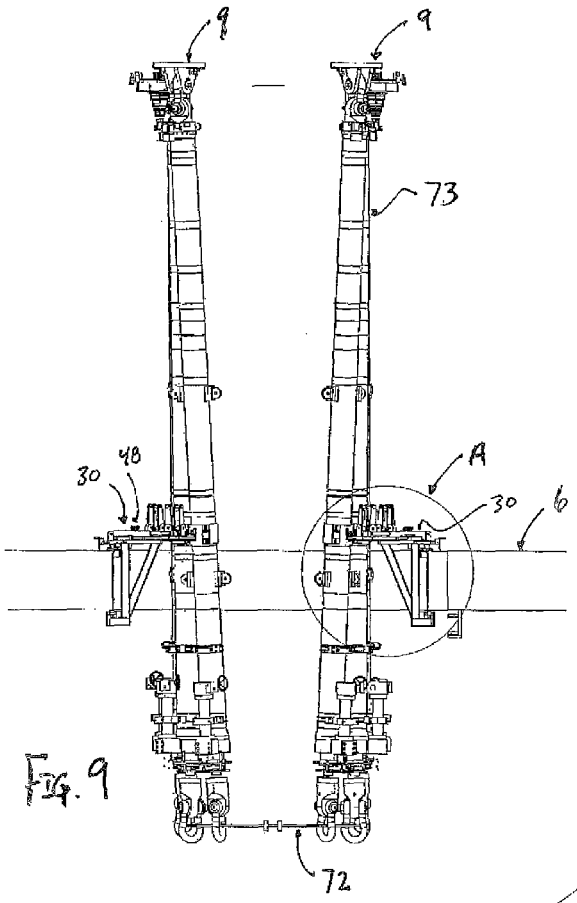
FIG. 9 is an elevation view similar to that of FIG. 1, but with a part of the lower deck removed to illustrate the connection between the carriage and the lower deck.
Figure 10:
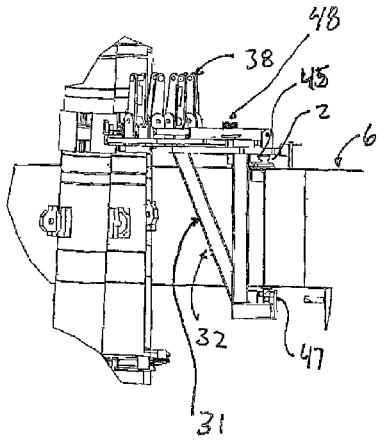
FIG. 10 is an enlargement of the area "A" in FIG. 9.

The carriage 32 is essentially a steel frame, comprising motor and cog wheels, schematically illustrated as reference number 45, for driving interaction with the rack 2. Struts 31 support the trolley via sliding brackets 47 which run along the underside of the moonpool edge (FIGS. 4, 9). The carriage comprises bolts 44 (see FIGS. 5, 6) by means of which the carriage can be locked to the deck 6 via corresponding holes (not shown) in the deck.

Figure 7:
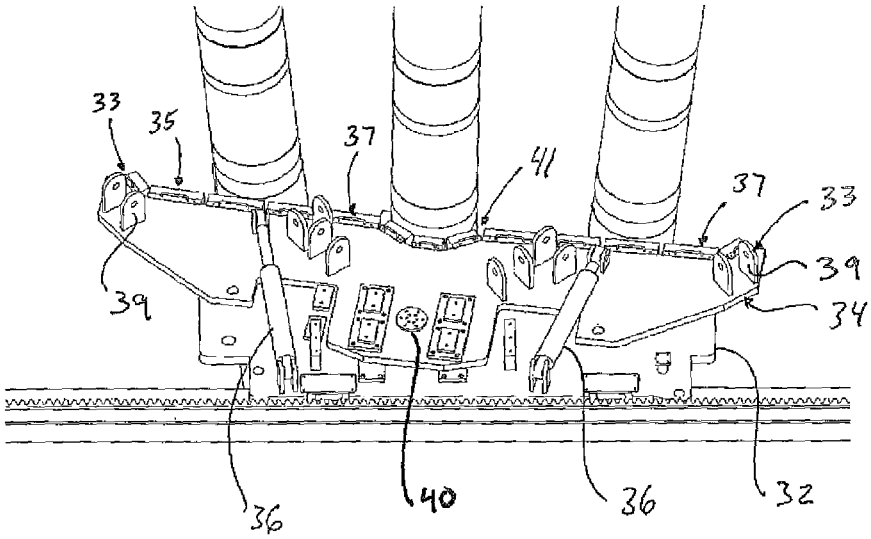
Figure 11:
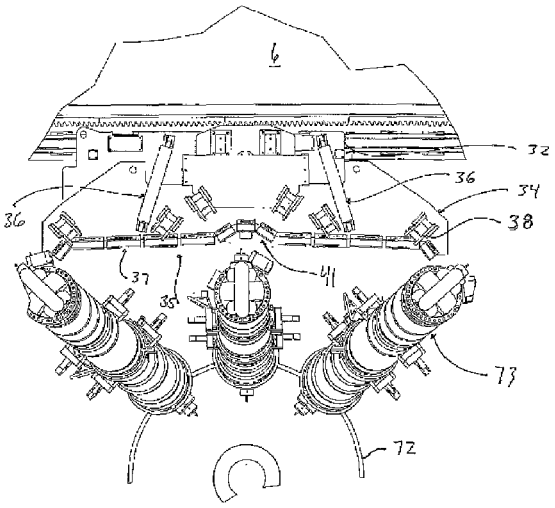
FIG. 11 is a perspective view illustrating the actuators, and hence the plate, in a retracted position.

The restraining plate 34 is supported by the trolley and is rotatably connected to the trolley via a pivot bolt 40 extending through a slot 42 in the carriage. As illustrated, the slot 42 is arranged perpendicularly with respect to the moonpool sidewalls. The plate 34 is hence rotatable in the horizontal plane, about the bolt axis. Furthermore, as the pivot bolt is movable in the slot 42, the plate may also translate away from and towards the moonpool wall. Movement of the plate is provided by two conventional hydraulic actuators 36 (power and control lines not shown), whereby the plate may be extended into contact with one or more of the DAT cylinders (see e.g. FIG. 5), and retracted so that the plate is not in of contact with the DAT cylinders (see FIG. 11). The actuators 36 may be operated independently of one another, thereby arranging the plate 34 in an oblique position as shown in FIG. 7.

The plate 34 is furnished with a recessed abutment edge 35, provided with shock absorbing padding 37, for abutment against the DAT cylinders as illustrated. Protrusions 33 on both sides of the abutment edge define an engagement range, or envelope, for the restraining plate. As the DAT cylinders are arranged in a circle (best shown in FIG. 3) the groups of three cylinders are not on a straight line. A further recess 41 (see e.g. FIG. 7 and FIG. 11) is therefore provided in the edge 35, in order to accommodate the middle cylinder.

The plate 34 comprises a number of lugs 38, two for each cylinder 73. Each lug 38 is connected to the plate via a pivot joint 39 (see FIG. 7, where lugs have been removed for illustration purposes), and may thus be rotated in to a locking engagement with respective DAT cylinder via a lock 77 on the cylinder. The locks 77 are conveniently arranged on a collar 74 which is clamped onto the cylinder. The lugs may be operated manually of mechanically. When the lugs 38 are engaging the lock 77, the respective cylinder is locked to the plate 34.

The plate comprises bolts 43 (see FIGS. 5, 6) by means of which the plate 34 can be locked to the carriage 32 via corresponding holes (not shown) in the carriage.

When the DAT system is to be seafastened, the lugs 38 are connected to the respective locks 77 on the cylinders, the restraining plate 34 is locked to the carriage 32 via the bolts 43, and the carriage 32 is locked to the deck 6 via the bolts 44. The bolts 43, 44 are preferably hydraulically operated. Enormous reaction forces must be absorbed during seafastening modus, therefore massive mechanic locks are necessary.

The operation of the trolley, e.g. movement of the carriage along the rail and of the actuator cylinders, is provided by remote radio control means and proportional valves, on/off valves, hydraulics and electricity, using conventional equipment (not shown). A control unit is schematically illustrated as 48 in FIGS. 9 and 10.

Figure 8:
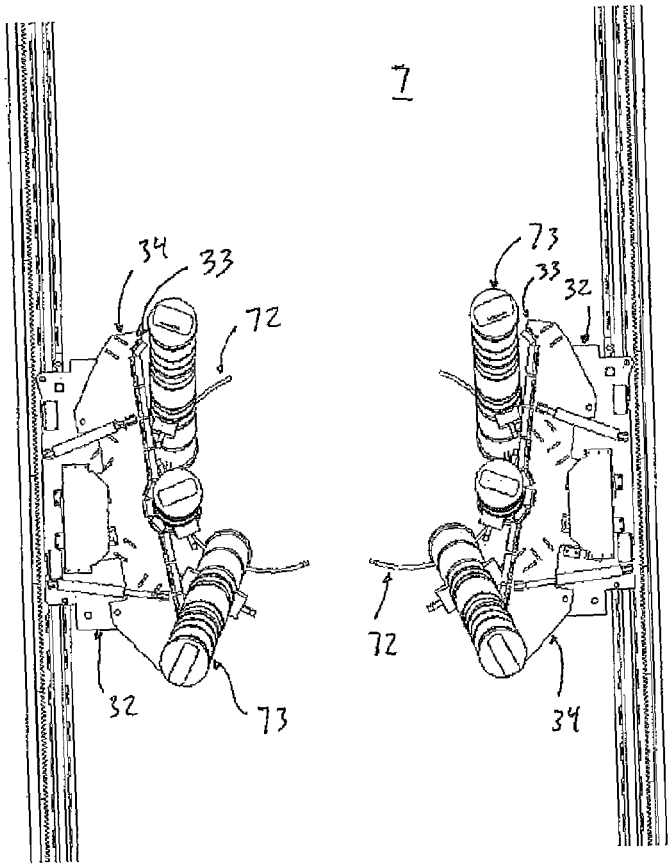
FIG. 8 shows a view similar to that of FIG. 3, but illustrates a mode in which the tensioner ring is open.

Referring to FIG. 8, some semi-submersible rigs have a double-hinged riser tension ring to enable opening and connection from both BOP side and x-mas tree side. This means that the DST must be able to stabilize the DAT system during skidding and connection to the telescopic joint from both sides.

The possibility of extending and retracting the stabilizing plate 34 (and to rotate it in the horizontal plane, as shown in FIG. 7) is vital for preventing movements and oscillations of the DAT cylinders due to rig motions whenever the DAT system is not connected to a riser. The plate 34 is also capable of stabilizing the DAT cylinders during opening of the hinged tension ring from either side.

FIG. 7 illustrates a stabilizing or guiding mode, and shows how the plate 34 compensates for the tension ring opening on the right side (FIG. 8). By driving the stabilizer plate actuators 36 at uneven stroke, the stabilizing plate 34 will tilt around the pivot point bolt 40 and also slide in the slot 42 in the carriage 32. Each driving actuator 36 comprises a cylinder with separate proportional valves and accumulators. The proportional valve is configured to drive the cylinder and adjust its stroke. The accumulator is configured to absorb movements and shock from the DAT cylinder assembly during this stabilizing mode. The reaction forces during skidding between the parked positions are not as great as with seafastening mode and will be handled by the stabilizing plate driving cylinders and accumulators.

Examples of how to operate the DST will now be described.

The DST 30 can bring the DAT cylinders 73 to well centre C from either the parked position on the BOP side (PB) or on x-mas tree side (PX). Since these scenarios are similar, only handling from and to the x-mas tree side is described here.

a) Connecting to Telescopic joint coming from x-mas tree side:

| No. | Sequence: | Description |
|---|---|---|
| 1 | Starting with DAT cylinders 73 seafastened to DST 30 in parked position on x-mas tree side PX. | |
| 2 | Disconnect seafastening lugs 38 from DAT cylinders | One cylinder for each lock and two locks for each DAT cylinder. The two locks for one cylinder can be handled through the same valve, i.e. three 3 valves for each trolley. DAT cylinders are now controlled only by the envelope of the stabilizer plates 34. |
| 3 | Retract plate locking bolts 43 | Driving the two cylinders connected to the bolts through activating one common on/off valve. The cylinders have an internal spring which ensures locked position even if hydraulic pressure is lost. |
| 4 | Retract trolley locking bolts 44 | Driving the two cylinders connected to the bolts through activating one common on/off valve. The cylinders have an internal spring which ensures locked position even if hydraulic pressure is lost. |
| 5 | Drive the two DST 30 and trip saver 9 towards well centre C. Stabilize cylinders during travel by means of DSTs and respective plates 34 | Both carriages 32 must be traveling at the same pace as the trip saver plates 9. This can be accomplished by having a laser connected to the trip saver and a target plate (centre area mark) on the DST trolley on which laser must stay within. |
| 6 | Stop DSTs and trip saver to prepare tension ring 72 and DST for connecting to telescopic joint | |
| 7 | Activate dampening function of the stabilizer plate | This is done by electrically activating two on/off valves connecting an accumulator to respective actuator cylinders 36. This enables the stabilizer plate 34 to follow the DAT cylinders' 73 movements as connection to the telescopic joint takes place. This function can be one common switch for both valves on the remote panel. |
| 8 | Stabilize cylinders 73 during tension ring opening | Drive and/or align the stabilizer plate 34 to compensate for the angle of tension ring opening. The accumulators (not shown) will absorb this movement; however helping by driving stabilizer plate will reduce the necessary force in tension ring opening. |
| 9 | Drive DSTs and trip saver towards telescopic joint in well centre. | Since the rig is rolling and pitching relative to the vertical telescopic joint, the DAT cylinders' lower part (and the tension ring) will have to change its movement from following the motion of the rig, to following that of the telescopic joint. |

-continued

| No. | Sequence: | Description |
|---|---|---|
| 10 | Close tension ring 72 | Drive the stabilizer plates 34 on both DSTs to follow the DAT cylinders' movement as the tension ring is closing. As the DAT cylinders start to leave the roll and pitch motions of the rig, the stabilizer plates will adopt the relative motion to the cylinders by means of the cylinders and accumulators on the respective DST. |
| 11 | Retract the stabilizer plates | Stabilizer plate will centre it self when both actuators 36 reach end stop. |
| 12 | Drive both DSTs back to parked position on x-mas tree side | |
| 13 | Lock both DSTs to deck with trolley locking bolts and verify that bolts are fully engaged | |

b) Disconnecting from Telescopic Joint Coming from X-Mas Tree Side:

| No. | Sequence: | Description |
|---|---|---|
| 1 | Starting with DAT cylinders connected to the telescopic joint (not shown) in well centre position C and both DSTs 30 parked and locked on x-mas tree side PX | |
| 2 | Retract trolley locking bolts 44 | |
| 4 | On both DSTs, ensure the stabilizer plate 34 is all the way retracted and locking bolts retracted (disengaged from deck) | |
| 3 | Drive DSTs all the way to well centre position C | |
| 4 | Activate dampening function of the stabilizer plates | This enables the stabilizer plates to follow the DAT cylinders' movements as disconnection from telescopic joint takes place. |
| 5 | Extend the stabilizer plate until reached contact with the DAT cylinders | Motions relative to the trolleys will be absorbed by the trolley cylinders and accumulators. |
| 6 | Stabilize cylinders during tension ring opening | Drive and/or align the stabilizer plates to compensate for the angle of tension ring opening. The accumulators will absorb this movement; however helping by driving stabilizer plate will reduce the necessary force in tension ring opening. |
| 7 | Drive DSTs and trip saver away from telescopic joint in well centre. | Since the telescopic joint is hanging more or less vertical and the rig is rolling and pitching, the DAT cylinders lower part (and tension ring) will now gradually have to start following the movements of the rig. This will lead to reduced movement/compensation of the stabilizer plate until DAT cylinders are following the motion of the rig completely. |
| 8 | Close tension ring when DST and Trip saver is far enough away from telescopic joint | Drive the stabilizer plates to follow the DAT cylinders movement as the tension ring is closing. |
| 9 | Deactivate dampening function of the stabilizer plates | |
| 10 | Drive DSTs and trip saver all the way to parked position on x-mas tree side. Stabilize cylinders during travel. | Both trolleys 30 must be traveling at the same pace as the trip saver plates. This can be aided with the same laser as mentioned in table above. |
| 11 | Lock DSTs 30 to deck 6 by means of trolley locking bolts 44 and verify that bolts are fully engaged | |
| 12 | Lock stabilizer plate to trolley with plate locking bolts 43 and verify that bolts are fully engaged | Adjust position of stabilizer plate by driving the respective cylinders |
| 13 | Connect seafastening lugs 38 to each DAT cylinder 73 and verify correct connection | |

The invention claimed is:

1. A restraining device for a tensioner assembly which is suspended by a first supporting structure on an offshore platform or vessel and extending into a moonpool, comprising a pair of apparatuses arranged on opposite sides of the moonpool and individually movable on respective rails by a traction device in interaction with respective racks, each of the pair of apparatuses comprising:

a movable carrier configured for controllable movement along a second supporting structure of the platform or vessel;

a restraining member movably and rotatably connected to the movable carrier via a joint, wherein the restraining member comprises an abutment region for abutment with at least one element of the assembly, and an assembly-locking device configured to selectively and releasably lock the at least one element of the assembly to the restraining member.

2. The restraining device of claim 1, wherein the abutment region defines a first recessed portion of the restraining member between protruding ends.

3. The restraining device of claim 2, wherein the first recessed portion comprises a centrally located second recessed portion which has a shape which is complementary with the at least one element of the assembly.

4. The restraining device of claim 3, further comprising actuator means connected between the carrier and the restraining member and configured for controllably moving the restraining member with respect to the carrier and the assembly, between a first position where at least a portion of the abutment region is in contact with the at least one element of the assembly and a second position where the abutment region is not in contact with the assembly.

5. The restraining device of claim 3, wherein the joint comprises a bolt extending through the restraining member and through an elongated slot in the carrier, whereby the restraining member is rotatable about an axis of the bolt and movable in the slot longitudinal direction.

6. The restraining device of claim 2, further comprising actuator means connected between the carrier and the restraining member and configured for controllably moving the restraining member with respect to the carrier and the assembly, between a first position where at least a portion of the abutment region is in contact with the at least one element of the assembly and a second position where the abutment region is not in contact with the assembly.

7. The restraining device of claim 2, wherein the joint comprises a bolt extending through the restraining member and through an elongated slot in the carrier, whereby the restraining member is rotatable about an axis of the bolt and movable in the slot longitudinal direction.

8. The restraining device of claim 1, further comprising actuator connected between the carrier and the restraining member and configured for controllably moving the restraining member with respect to the carrier and the assembly, between a first position where at least a portion of the abutment region is in contact with the at least one element of the assembly and a second position where the abutment region is not in contact with the assembly.

9. The restraining device of claim 8, wherein the joint comprises a bolt extending through the restraining member and through an elongated slot in the carrier, whereby the restraining member is rotatable about an axis of the bolt and movable in the slot longitudinal direction.

10. The restraining device of claim 1, wherein the joint comprises a bolt extending through the restraining member and through an elongated slot in the carrier, whereby the restraining member is rotatable about the bolt an axis of the bolt and movable in the slot longitudinal direction.

11. The restraining device of claim 1, further comprising a member-locking device configured to releasably and selectively lock the restraining member to the carrier.

12. The restraining device of claim 1, further comprising a carrier-locking device configured to releasably and selectively lock the carrier to the second supporting structure.

13. The restraining device of claim 1, wherein the carrier comprises a traction device configured to interact with a track on the second supporting structure and a support configured to interact with the second supporting structure.

14. The restraining device of claim 1, wherein the restraining member comprises a plate element slidably supported by, and movably connected to, the carrier.

15. The restraining device of claim 1, wherein the tensioner assembly is suspended by trip-savers slidably attached to the first supporting structure, and the first supporting structure comprises the lower side of a drill floor.

16. The restraining device of claim 1, wherein each apparatus comprises a motion control device configured to control the motion of the apparatus on the rails.

17. The restraining device of claim 1, wherein the tensioner assembly comprises a plurality of tensioner cylinders and the restraining member of each apparatus is configured for restraining half of the total number of tensioner cylinders.

18. The restraining device of claim 17, wherein the restraining member is a plate having a recessed abutment portion which comprises a resilient material, for abutment against the tensioner cylinders.

19. The restraining device claim 1, wherein the tensioner assembly is a Direct Acting Tensioner (DAT) assembly, and each restraining member comprises locking lugs for selective and releasable locking interaction with corresponding locks on respective collars on each respective tensioner cylinder.

* * * * *